US010408208B2

(12) United States Patent
Williams et al.

(10) Patent No.: US 10,408,208 B2
(45) Date of Patent: Sep. 10, 2019

(54) SYSTEMS AND METHODS FOR CONTROLLING DOWNHOLE LINEAR MOTORS

(71) Applicant: Baker Hughes Incorporated, Houston, TX (US)

(72) Inventors: Gary Williams, Broken Arrow, OK (US); Evan G. Mackay, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 303 days.

(21) Appl. No.: 15/075,195

(22) Filed: Mar. 20, 2016

(65) Prior Publication Data

US 2016/0273528 A1 Sep. 22, 2016

Related U.S. Application Data

(60) Provisional application No. 62/135,986, filed on Mar. 20, 2015.

(51) Int. Cl.
*F04B 49/20* (2006.01)
*E21B 43/12* (2006.01)
(Continued)

(52) U.S. Cl.
CPC ..... *F04B 49/20* (2013.01); *E21B 43/128* (2013.01); *F04B 17/03* (2013.01); *F04B 47/06* (2013.01);
(Continued)

(58) Field of Classification Search
CPC ..... F04B 17/03; F04B 17/04; F04B 17/042; F04B 17/044; F04B 35/04; F04B 35/045; F04B 47/06; F04B 49/06; F04B 49/12; F04B 49/20; F04B 51/00; F04B 51/2201; F04B 51/0202; F04B 220/0201; F04B 2203/04; F04B 2203/0401;
(Continued)

(56) References Cited

U.S. PATENT DOCUMENTS 4,673,827 A * 6/1987 Sommer ..... F15B 15/2807 307/116
4,687,054 A * 8/1987 Russell ..... E21B 43/00 166/105

(Continued)

*Primary Examiner* — Bryan M Lettman
*Assistant Examiner* — Charles W Nichols
(74) *Attorney, Agent, or Firm* — Sprinkle IP Law Group

(57) ABSTRACT

Systems and methods for controlling downhole linear motors to minimize connections to surface equipment. In one embodiment, an ESP system is coupled by a power cable to equipment at the surface of a well. The ESP system includes a linear motor and a reciprocating pump. The motor has a set of position sensors that sense the position of a mover in the motor. Combining circuitry (E.G., XOR gate) combines the outputs of the position sensors into a single composite signal in which signal components corresponding to the position sensors are indistinguishable. A single channel carries the composite signal from the ESP system to the surface equipment. A control system determines a starting position of the motor and determines its subsequent position based on transitions in the composite signal. The motor is then operated based on the position determined from the composite signal.

9 Claims, 7 Drawing Sheets

(51) Int. Cl.
*F04B 17/03* (2006.01)
*F04B 51/00* (2006.01)
*F04B 47/06* (2006.01)

(52) U.S. Cl.
CPC ..... *F04B 51/00* (2013.01); *F04B 2201/0201* (2013.01)

(58) Field of Classification Search
CPC ..... F04B 2203/0402; F04B 2203/0409; E21B 43/128
USPC ..... 318/3, 334, 335
See application file for complete search history.

(56) References Cited

U.S. PATENT DOCUMENTS 5,049,046 A * 9/1991 Escue ..... E21B 43/128 166/66
2004/0169480 A1* 9/2004 Ueda ..... B26B 19/282 318/114
2009/0213267 A1* 8/2009 Musunuri ..... H04N 5/0733 348/530
2013/0098632 A1* 4/2013 Wetzel ..... E21B 43/128 166/373

* cited by examiner

SYSTEMS AND METHODS FOR CONTROLLING DOWNHOLE LINEAR MOTORS

CROSS-REFERENCE TO RELATED APPLICATIONS

This application claims the benefit of U.S. Provisional Patent Application 62/135,986, filed Mar. 20, 2015 by Gary Williams, et al., which is incorporated by reference as if set forth herein in its entirety.

BACKGROUND

Field of the invention.

The invention relates generally to downhole tools for use in wells, and more particularly to means for controlling a downhole linear motor from the surface of a well in a manner that minimizes the connections that are necessary to communicate between the surface equipment and the downhole linear motor.

Related art.

In the production of oil from wells, it is often necessary to use an artificial lift system to maintain the flow of oil. The artificial lift system commonly includes an electric submersible pump (ESP) that is positioned downhole in a producing region of the well. The ESP has a motor that receives electrical signals from equipment at the surface of the well. The received signals run the motor, which in turn drives a pump to lift the oil out of the well.

ESP motors commonly use rotary designs in which a rotor is coaxially positioned within a stator and rotates within the stator. The shaft of the rotor is coupled to a pump, and drives a shaft of the pump to turn impellers within the body of the pump. The impellers force the oil through the pump and out of the well. While rotary motors are typically used, it is also possible to use a linear motor. Instead of a rotor, the linear motor has a mover that moves in a linear, reciprocating motion. The mover drives a plunger-type pump to force oil out of the well.

In order to efficiently drive a linear motor, the position of the mover within the stator must be known. Linear motors typically use three Hall-effect sensors to determine the position of the mover. These three signals are provided to a control system, which then produces a drive signal based upon the position of the mover and provides this drive signal to the motor to run the motor.

If the linear motor is to be used in a well, however, there may be a number of problems with this arrangement. For example, because the motor is positioned in a well, it is necessary to communicate the mover position signals over a substantial length (thousands, or even tens of thousands of feet) of cabling to equipment at the surface of the well. It is therefore impractical simply to provide the wires for separate electrical lines to communicate the mover position signals from the linear motor to the surface equipment. Even if the mover position signals were serially combined and communicated over a single electrical line, the higher bandwidth signal, which must be transmitted adjacent to the power cable, which carries high motor switching currents and will therefore degrade the signal-to-noise ratio of the mover position signals.

It would therefore be desirable to provide improved means for communicating necessary information about the position of the mover in a downhole linear motor to equipment at the surface of a well, and for utilizing this position information to generate signals to drive the linear motor.

SUMMARY OF THE INVENTION

This disclosure is directed to systems and methods for controlling downhole linear motors in a manner that minimizes the connections necessary to communicate between surface equipment and the downhole linear motors. In one particular embodiment, a system includes an ESP system that is coupled by a power cable to equipment positioned at the surface of a well. The ESP system includes a linear motor and a reciprocating pump that is coupled to be driven by the motor. The motor has a set of position sensors that are configured to sense that a mover of the motor is in a corresponding position within the motor. The ESP system also includes circuitry (an XOR gate, for example) that combines the outputs of each of the position sensors into a single composite signal. The signal components corresponding to each of the position sensors, such as rising or falling edges, are indistinguishable. In other words, the position sensors are not identifiable from the components of the composite signal. A single channel is coupled between the ESP system and the surface equipment to carry the composite signal from the ESP system to the surface equipment. This channel may be implemented on a dedicated signal line, or as a virtual channel on the power cable.

In one embodiment, the surface equipment includes a control system such as a VSD that receives the composite signal and produces output power for the ESP system based at least in part on the composite signal. The VSD may include a speed controller that is configured to determine a current speed of the motor and to control the VSD to produce output power which drives the ESP system at a desired speed. The control system may be configured to perform an initialization procedure at startup and thereby identify a starting position of the mover in the linear motor (e.g., at the bottom of the motor, which may be the top of the power stroke). After initialization, the control system may produce an initial power stroke voltage and monitor the composite signal to determine whether the mover has moved. If the mover has moved in response to the initial power stroke voltage, the control system continues to provide the initial power stroke voltage to the ESP system. If the mover has not moved in response to the initial power stroke voltage, the control system increases the output voltage and continues monitoring the composite signal to determine whether the mover has moved in response to the increased voltage.

One alternative embodiment comprises a controller of the type that may be used in a VSD for an electric submersible pump (ESP) system. This controller is configured to receive a composite signal from an ESP system, where the composite signal includes signal components corresponding to a plurality of position sensors in the ESP system. The controller performs an initialization procedure in order to identify a starting position of a mover in the linear motor (which may involve moving mover to that position). The controller then produces output power based on the identified starting position of the mover in the linear motor and provides the output power to the linear motor of the ESP system. The control functions may be implemented, for example, in a variable speed drive (VSD) that includes a speed controller, where the speed controller is configured to receive the composite signal and to control the VSD to produce the output power at a frequency and a voltage that are determined based on the composite signal.

Another alternative embodiment comprises a method for controlling an ESP positioned downhole in a well, where the ESP has a linear motor and reciprocating pump, and where position sensors in the motor provide outputs that are combined into a composite signal that is conveyed to a control system at the surface of the well. The method includes receiving the composite signal in a drive controller, performing an initialization procedure to identify a starting position of a mover in the linear motor, and producing output power that drives the linear motor based on the identified starting position of the mover. In one embodiment, the initialization procedure involves producing an output voltage that is adapted to move the mover in a return stroke direction, monitoring the composite signal, and determining from the composite signal when the mover has moved to the end of the return stroke (the top of the power stroke). After determining that the mover has moved to the end of the return stroke, an output voltage is produced that is adapted to move the mover in a power stroke direction. This may include producing an initial power stroke voltage, monitoring the composite signal, and determining from the composite signal whether the mover has moved in response to the initial voltage. If the mover has moved in response to the initial voltage, the control system continues to produce this voltage. If the mover has not moved in response to the initial voltage, the voltage is increased and the composite signal continues to be monitored to determine whether the mover has moved in response to the increased voltage. As the mover moves through the power stroke, events in the composite signal corresponding to movement of the mover (e.g., signal transitions—rising or falling edges) are counted, and the count is compared to a predetermined maximum number. If the count has reached the predetermined maximum number, the power stroke is complete, and a return stroke voltage is produced. If the count has not reached the predetermined maximum number, the control system continues to produce the power stroke voltage. As the mover moves through the power stroke, the control system may compare a frequency of the linear motor to a power stroke profile and adjust the power stroke voltage based on the comparison.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
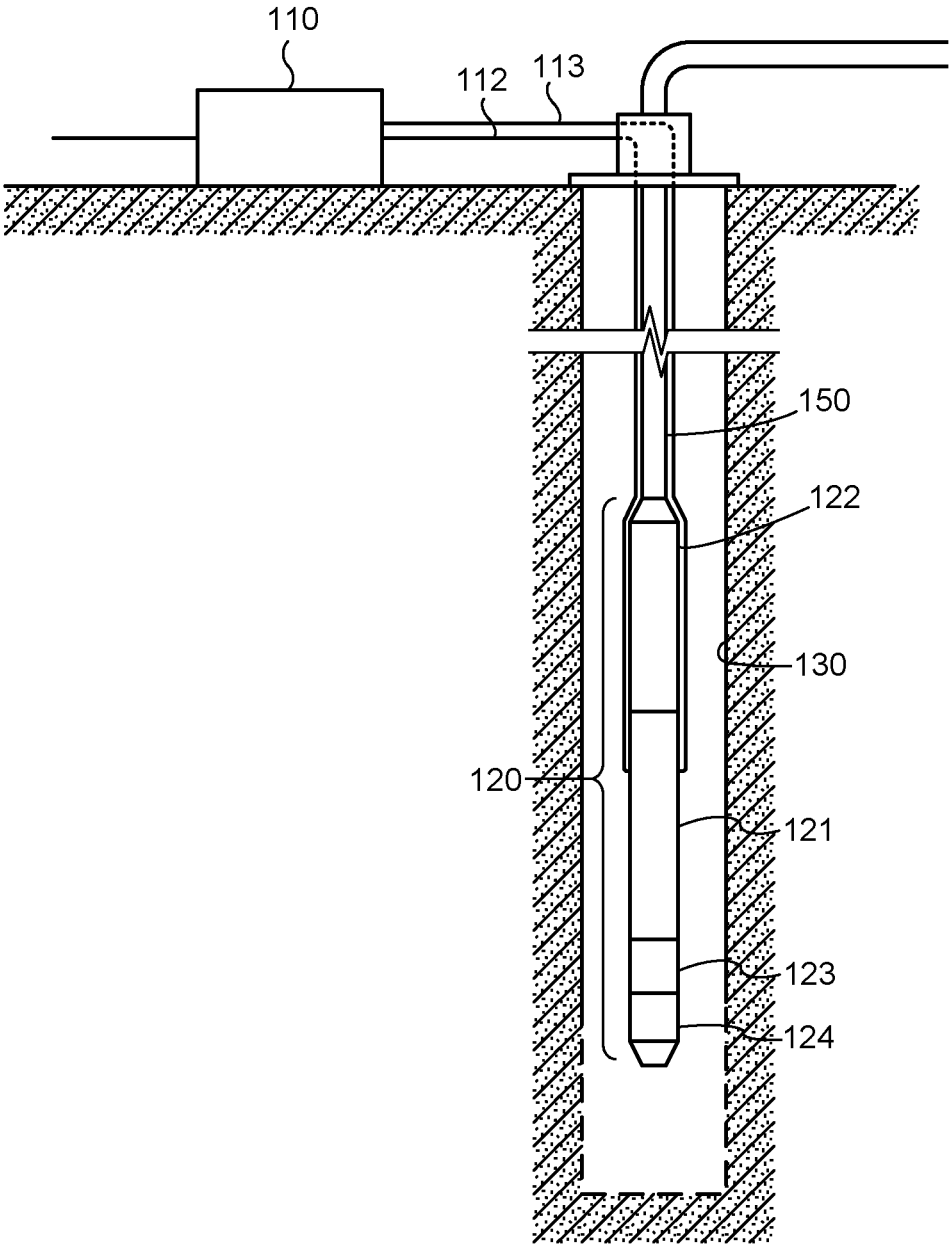
FIG. 1 is a diagram illustrating an exemplary pump system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims. Further, the drawings may not be to scale, and may exaggerate one or more components in order to facilitate an understanding of the various features described herein.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for communicating information between a downhole linear motor and controls for the motor which are located at the surface of a well, and operating the motor using the communicated information. The embodiments of the invention reduce the bandwidth and/or conductor count of the feedback signal from position sensors on the downhole motor to the drive at the surface of the well. Channels that are conventionally provided for this information have a very high cost, so reducing the channels reduces this cost. Additionally, the cost of downhole electronics is very high, so reducing the circuitry required in the motor results in additional cost savings, as well as extending the run life of the motor.

Referring to FIG. 1, a diagram illustrating an exemplary pump system in accordance with one embodiment of the present invention is shown. A wellbore 130 is drilled into an oil-bearing geological structure and is cased. The casing within wellbore 130 is perforated in a producing region of the well to allow oil to flow from the formation into the well. Pump system 120 is positioned in the producing region of the well. Pump system 120 is coupled to production tubing 150, through which the system pumps oil out of the well. A control system 110 is positioned at the surface of the well. Control system 110 is coupled to pump 120 by power cable 112 and a set of electrical data lines 113 that may carry various types of sensed data and control information between the downhole pump system and the surface control equipment. Power cable 112 and electrical lines 113 run down the wellbore along tubing string 150.

Pump 120 includes an electric motor section 121 and a pump section 122. In this embodiment, an expansion chamber 123 and a gauge package 124 are included in the system. (Pump system 120 may include various other components which will not be described in detail here because they are well known in the art and are not important to a discussion of the invention.) Motor section 121 receives power from control system 110 and drives pump section 122, which pumps the oil through the production tubing and out of the well.

In this embodiment, motor section 121 is a linear electric motor. Control system 110 receives AC (alternating current) input power from an external source such as a generator (not shown in the figure), rectifies the AC input power and then converts the DC (direct current) power to produce three-phase AC output power which is suitable to drive the linear motor. The output power generated by control system 110 is dependent in part upon the position of the mover within the stator of the linear motor. Position sensors in the motor sense the position of the mover and communicate this information via electrical lines 113 to control system 110 so that the mover will be driven in the proper direction (as will be discussed in more detail below). The output power generated by control system 110 is provided to pump system 120 via power cable 112.

Figure 2:
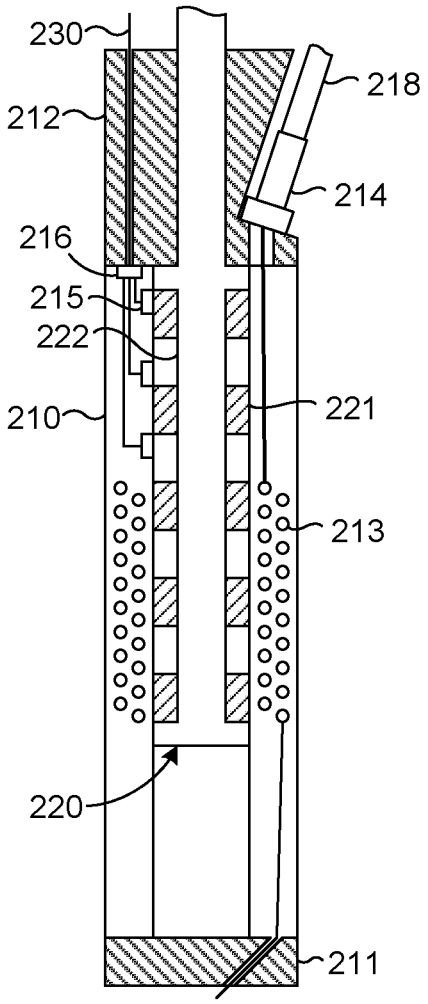
FIG. 2 is a diagram illustrating an exemplary linear motor in accordance with one embodiment which would be suitable for use in the pump system of FIG. 1.

Referring to FIG. 2, a diagram illustrating an exemplary linear motor which would be suitable for use in the pump system of FIG. 1 is shown. The linear motor has a cylindrical stator 210 which has a bore in its center. A base 211 is connected to the lower end of stator 210 to enclose the lower end of the bore, and a head 212 is connected to the upper end of the stator. Motor head 212 has an aperture therethrough to allow the shaft of the mover to extend to the pump.

Stator 210 has a set of windings 213 of magnet wire. The ends of the windings are coupled (e.g., via a pothead connector 214) to the conductors of the power cable 218. The windings are alternately energized to generate magnetic fields within the stator that interact with permanent magnets 221 on the shaft 222 of mover 220. The waveform of the signal on the power cable (in this case a three-phase signal) is controlled to drive mover 220 in a reciprocating motion within the bore of stator 210. Stator 210 incorporates a set of three Hall-effect sensors 215 to monitor the position of mover 220 within stator 210. The outputs of Hall-effect sensors 215 are each coupled to corresponding inputs of an XOR gate 216. The output of XOR gate 216 is connected to a single electrical line 230. In an alternative embodiment, the output of XOR gate 216 could be processed by additional circuitry that impresses this signal onto power cable 218 and thereby communicates the signal to the equipment at the surface of the well.

Conventionally, each of the three signals output by the Hall-effect sensors would be transmitted to the controller. In other words, each of the three distinct outputs of the Hall-effect sensors would be maintained. Additionally, the mover would be coupled to an absolute position encoder of some type and this data would also be transmitted to the controller. The transmission of all of this information would require either a high bandwidth signal or a wide signal bus consisting of separate wires. Because of the constraints of communicating between the downhole motor and the surface equipment, neither of these options is available. The present systems and methods therefore encode the Hall-effect sensor information into a single, real-time composite signal which is communicated from the linear motor to the drive system at the surface of the well. The absolute position encoder signal is removed altogether. The drive system is configured to track the motor position based on this single signal.

A nominal 24 volts DC is supplied from the drive at the surface to the linear motor. This voltage is converted to a local power voltage with a linear voltage regulator. The local voltage powers the circuitry in the motor, which includes the Hall-effect sensors and a quad XOR gate. The three Hall-effect sensors sense the passage of the magnets of the mover within the stator and pass this information to the XOR gate. The XOR gate encodes this information into a single differential signal which is a composite of the separate signals output by the Hall-effect sensors. The resulting waveform is a square wave with each edge (rising and falling) denoting a change in the location of the mover. These edges correspond to transitions between the six motor voltage steps that are generated by the drive system. The differential signal generated by the XOR gate is transmitted from the linear motor back to the drive at the surface of the well. The channel through which the signal is transmitted may be a dedicated physical signal line, or it may be a virtual channel through which the signal is communicated over the power leads that couple the motor to the drive at the surface of the well.

Figure 3:
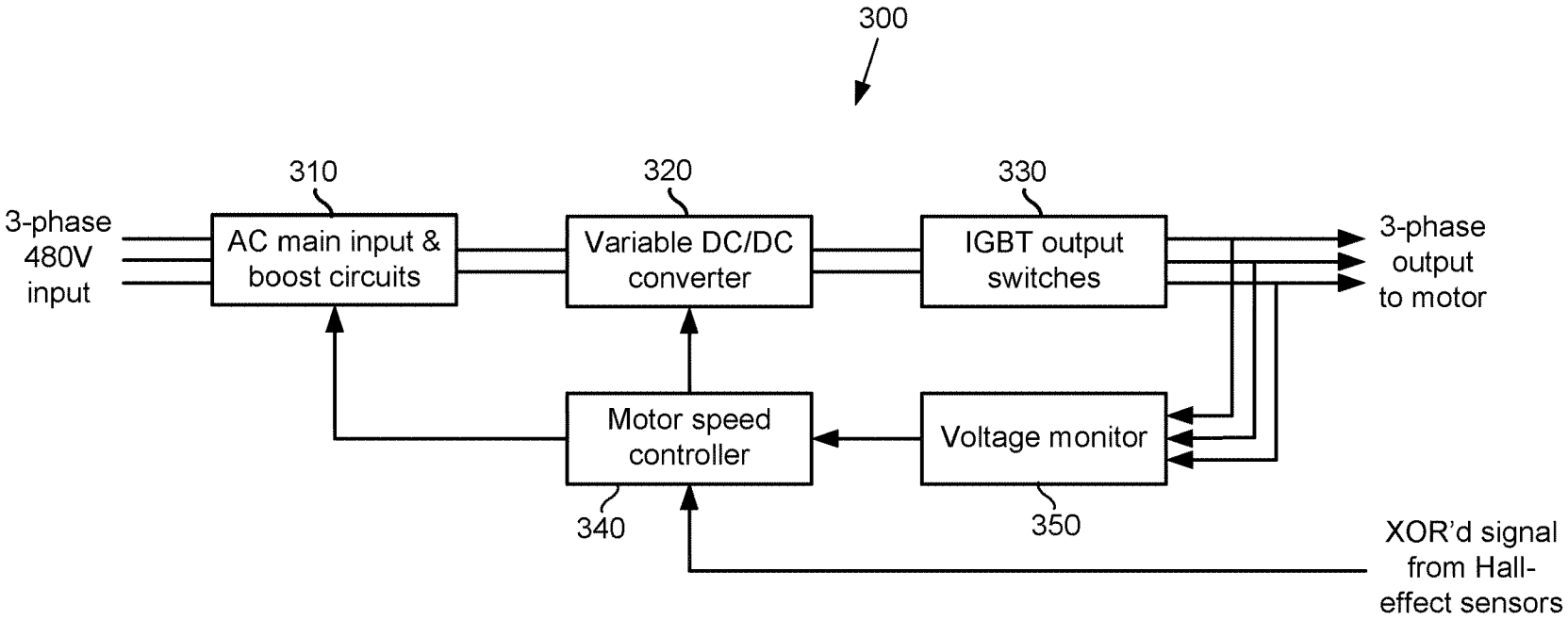
FIG. 3 is a functional block diagram illustrating the structure of a control system for a linear motor in accordance with one embodiment.

Referring to FIG. 3, a functional block diagram illustrating the structure of a control system for a linear motor in one embodiment is shown. The control system is incorporated into a drive system for the linear motor. The drive system receives AC input power from an external source and generates three-phase output power that is provided to the linear motor to run the motor. The drive system also receives position information from the linear motor and uses this information when generating the three-phase power for the motor.

As depicted in FIG. 3, drive system 300 has input and boost circuitry 310 that receives AC input power from the external power source. The input power may be, for example, 480V, three-phase power. Circuitry 310 converts the received AC power to DC power at a predetermined voltage and provides this power to a first DC bus. The DC power on the first DC bus is provided to a variable DC-DC converter 320 that outputs DC power at a desired voltage to a second DC bus. The voltage of the DC power output by DC-DC converter 320 can be adjusted within a range from 0V to the voltage on the first DC bus, as determined by a voltage adjustment signal received from motor speed controller 340. The DC power on the second DC bus is input to an inverter 330 which produces three-phase output power at a desired voltage and frequency. The output power produced by inverter 330 is transmitted to the downhole linear motor via a power cable.

The power output by inverter 330 is monitored by voltage monitor 350. Voltage monitor 350 provides a signal indicating the voltage output by inverter 330 as an input to motor speed controller 340. Motor speed controller 340 also receives position information from the downhole linear motor. In one embodiment, this position information consists of the output of the XOR gate as described above in connection with FIG. 2. Motor speed controller 340 uses the received position information to determine the position of the mover within the linear motor and, based upon this position information and the information received from voltage monitor 350, controls inverter 330 to generate the appropriate output signal. In one embodiment, motor speed controller 340 controls the switching of insulated gate bipolar transistors (IGBT's) in inverter 330 to generate the desired output waveform, which in this embodiment is a 6-step waveform.

The downhole linear motor is an electrically commutated motor. In other words, the commutation or changing of the voltage of the power provided to the motor is accomplished via the surface drive unit. The edges of the XOR'd signal from the Hall-effect sensors are indications of where the commutation should occur. This is explained in more detail in connection with FIGS. 4 and 5.

Figure 4:
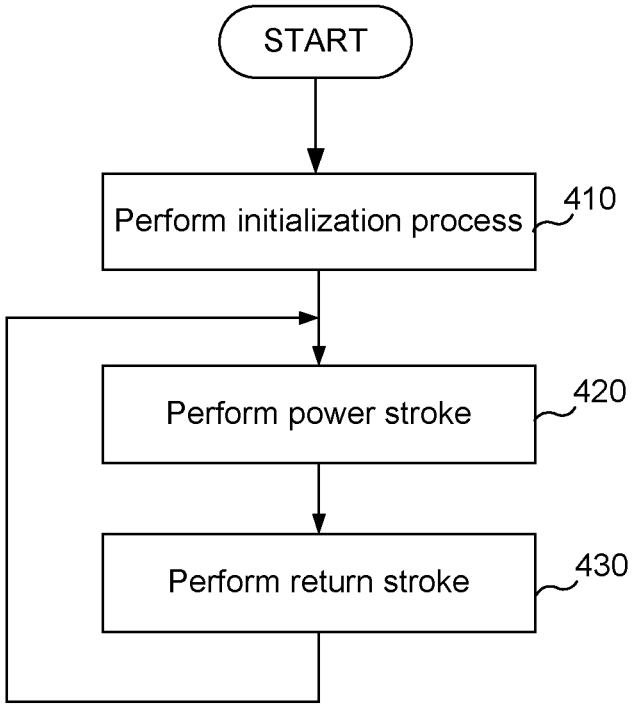
FIG. 4 is a flow diagram illustrating a scheme through which the motor speed controller controls the inverter to generate the output waveform that drives the motor in accordance with one embodiment.
Figure 5A:
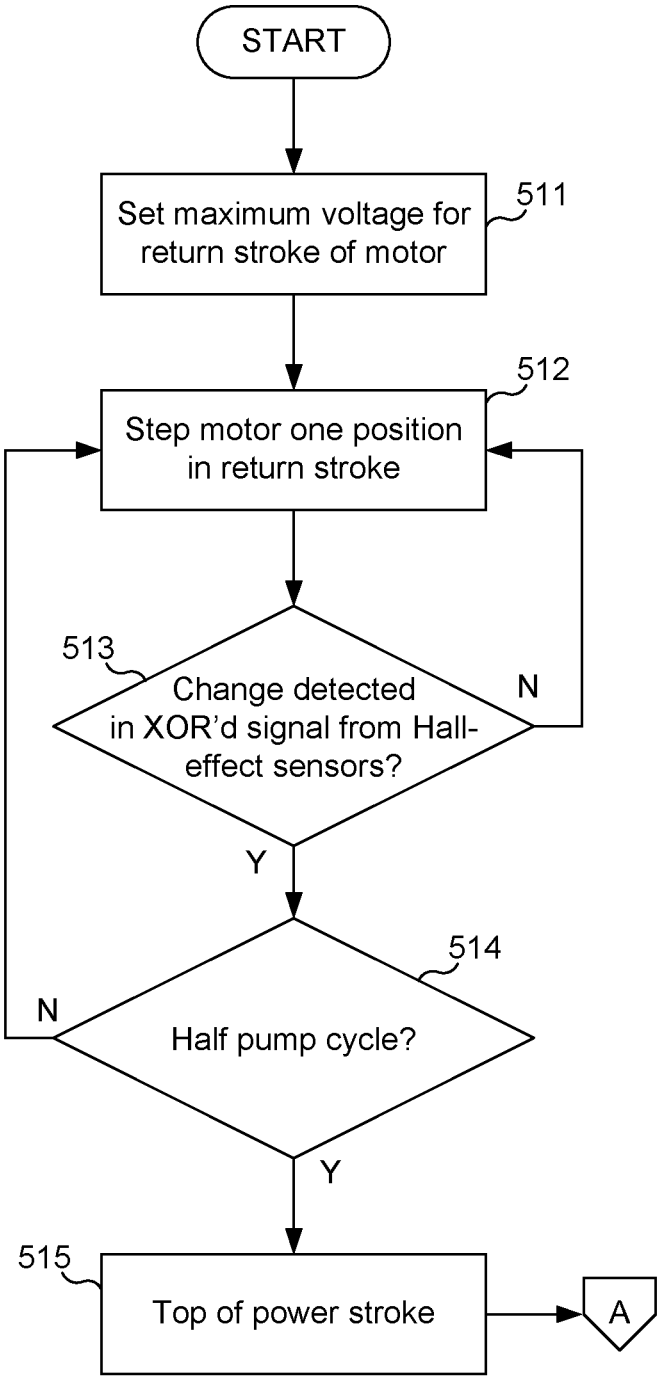
FIGS. 5A-5C are diagrams illustrating the control scheme of FIG. 4 in more detail.
Figure 5B:
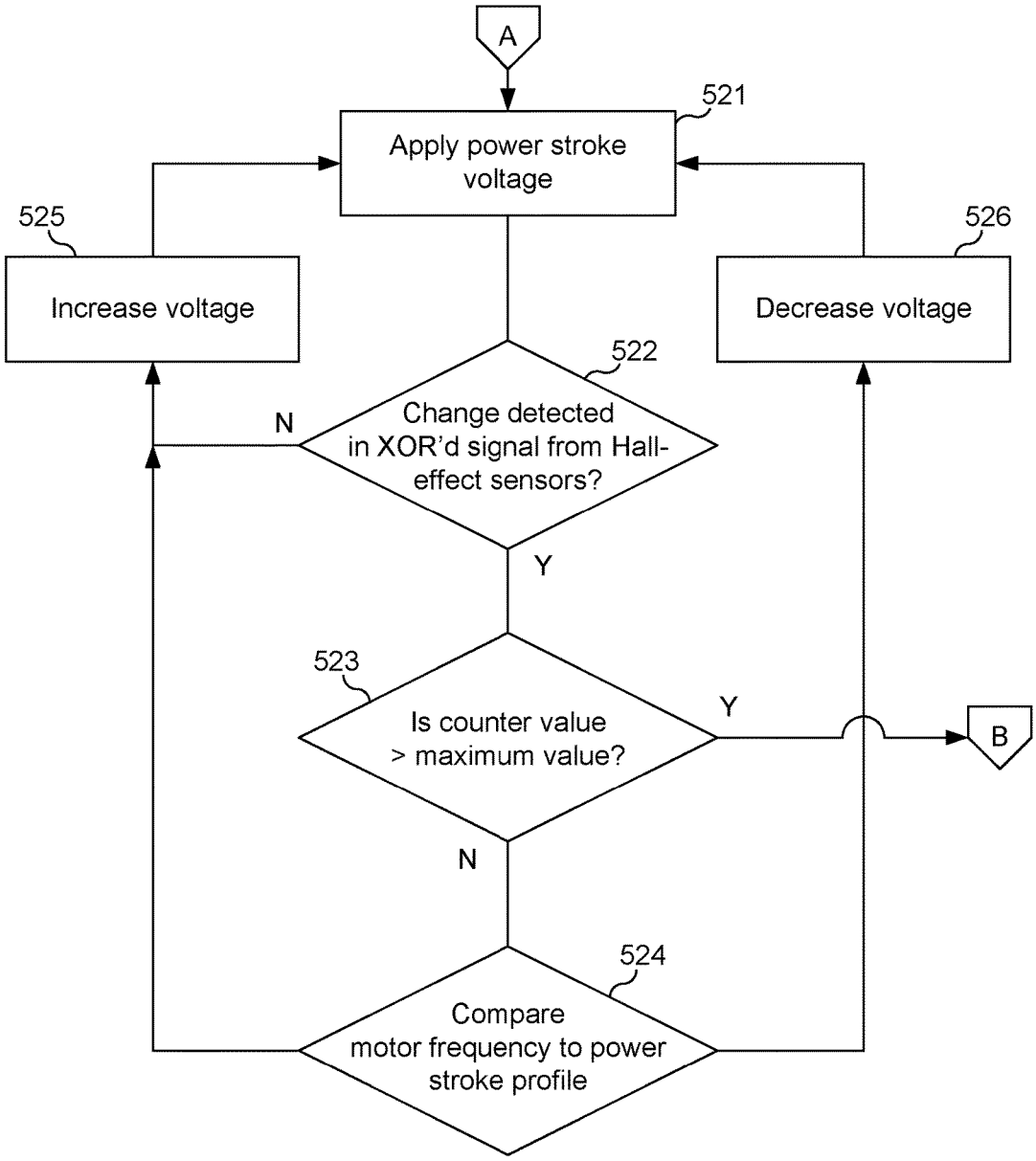
Figure 5C:
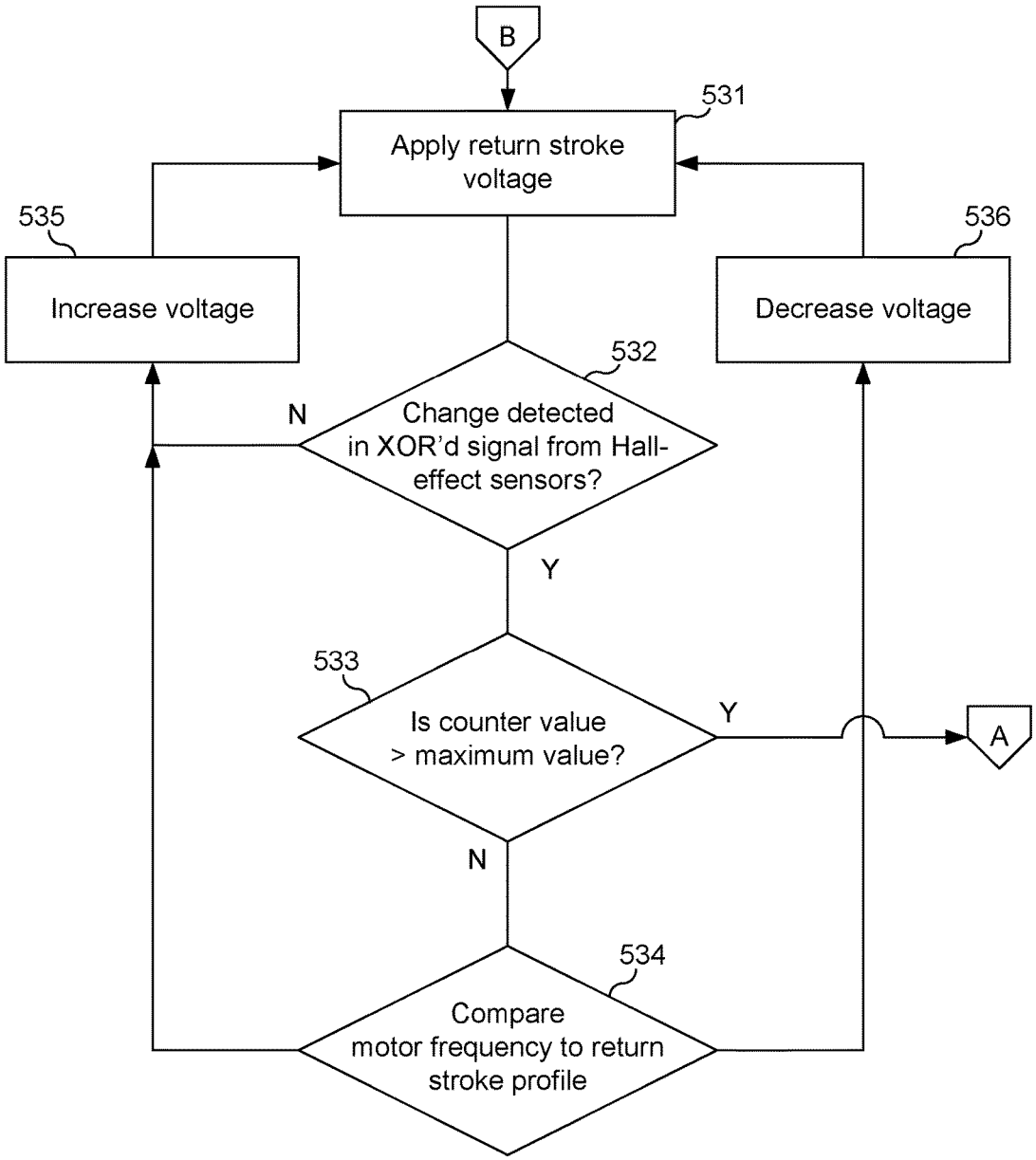

FIGS. 4 and 5 are flow diagrams illustrating the scheme through which the motor speed controller controls the inverter to generate the output waveform that drives the motor. FIG. 4 depicts the three basic stages of this process, while FIG. 5 shows the process in more detail.

As noted above, the absolute position of the mover within the linear motor is not communicated to the drive—the outputs of the Hall-effect sensors are XOR'd, so the signal received by the motor speed controller indicates the points at which edges occur in all three of the sensor signals. The drive must therefore determine where the mover is positioned within the motor. In order to do this, the drive performs an initialization process (410) when the unit is powered up. In one embodiment, this consists of applying a voltage to the motor that is known to be sufficient to cause the mover to travel to the top of the power stroke. The return stroke direction is used for this purpose because the force required to move in this direction is less than the power stroke direction, and the required force is predictable, regardless of the depth of the well or other well-specific parameters. The initialization procedure can optionally be repeated in the power stroke direction to verify that the full stroke length is obtainable.

After the motor has been initialized, it can be assumed that the mover is at the top of the power stroke. The drive then produces the appropriate output voltages for the power stroke (420) and, as it does so, the drive monitors the XOR signal and interprets each edge as the edge of one of the Hall-effect sensor signals. Since the edges of these signals occur in a known order during the power stroke of the motor, the drive effectively knows which of the sensors generated each edge of the received signal. At the end of the power stroke, it is known that the mover is at the top of the return stroke, so the appropriate voltages are generated for the return stroke (430). As the mover moves through the return stroke, the drive continues to monitor the XOR signal and interprets each edge as the edge of one of the Hall-effect sensor signals, which occur in a known order during the return stroke.

The commutation of the motor (repeating power stroke 420 and return stroke 430) can be performed automatically. This will allow the motor to run smoothly, with transitions in the XOR'd Hall-effect sensor signal being reported to the drive. As noted above, counting the transitions in this signal allows tracking of the mover position. Additionally, the frequency of the transitions is used to determine the mover speed. The voltage on the second DC bus can be adjusted to make the mover go faster (by making the DC bus voltage higher) or slower (by making the DC bus voltage lower). The combination of the frequency of the transitions and the motor current that is supplied to the motor can also be used for well diagnostics (e.g., determining the presence of gas, stuck valves, etc.)

In one embodiment, an inhibit mode is included in the hardware (e.g., by setting an appropriate bit) so that the hardware commutation of the motor is disabled during the initialization process. The drive can then manually commutate the motor in the return direction and monitor the XOR'd Hall-effect sensor signals, which indicates that the mover is moving in response to each step change in the motor voltages. Initially, the motor may move backwards to get in sync—this is acceptable behavior and does not affect the outcome of the initialization routine. The mover will eventually come to rest against a hard stop located in the end of the motor. When this point is reached, the XOR'd Hall-effect sensor input signal will stop transitioning. After the initialization phase has been completed, the inhibit bit may be released, and commutation of the motor can be done automatically in hardware.

Referring to FIG. 5, the drive starts the initialization phase of the process by causing the mover to travel through the return stroke to the top of the power stroke. Depending upon the initial position of the mover, it may not have to travel through the entire return stroke. The maximum voltage and current that should be necessary to move the mover in the return stroke direction (under essentially any well conditions) are known, so the drive output is set to this maximum voltage (511). The motor is stepped forward one position in the return stroke (512), and the XOR'd signal from the Hall-effect sensors is monitored for changes. If there are changes in the signal (513), the mover is advancing in the return stroke, so the drive output is controlled to advance the motor another step in the return stroke (512). These steps are continued until the stepping the motor results in no changes in the XOR'd Hall-effect sensor signal. This indicates that the mover has completed the return stroke. A stop in the motor prevents the mover from moving any farther in the return stroke direction. At this point, the mover is at the top of the power stroke (515), and the drive output should be at the halfway point of its electrical cycle (514).

After the initialization phase has been completed, the power stroke is initiated. In this phase, an initial power stroke voltage is output to the motor (521). The XOR'd signal from the Hall-effect sensors is monitored for changes indicating movement of the mover (522). If there are no changes in the signal, it is assumed that the mover has not moved, so the voltage is increased (525), and the increased voltage is provided to the motor (521). If there are changes in the signal, the detected edges increment a counter, and the value of the counter is compared to a maximum value (523). If the maximum value has not been reached, the power stroke is not complete, so the output voltage is compared to a profile of the power stroke to determine whether the output voltage should be increased (525) or decreased (526). After the voltage is adjusted as needed, the new voltage is output to the motor (521). Returning to comparison 523, if the counter has reached the maximum value, the power stroke is complete.

After completion of the power stroke, the return stroke is initiated. The steps performed by the drive during the return stroke are similar to those performed during the power stroke, except that they are adapted to move the motor's mover in the opposite direction. Since the pump is not lifting oil out of the well during the return stroke, the voltages required to be output by the drive will normally be less than the voltages output during the power stroke.

At the beginning of the return stroke, an initial return stroke voltage is output to the motor (531). The drive monitors the XOR'd Hall-effect sensor signal to detect changes which indicate movement of the mover (532) in the return direction. If there are no changes in the signal, indicating no movement of the mover, the voltage is increased (535). This increased voltage is provided to the motor (531). If, on the other hand, there are changes in the signal, the counter is incremented to count the signal's edges. The value of the counter is then compared to the maximum value (533) to determine whether the return stroke is complete. If the count is less than the maximum value, the output voltage is compared to a return stroke profile (534) to determine whether the output voltage should be increased (535) or decreased (536). The voltage is adjusted as indicated by the comparison to the return stroke profile, and the new voltage is output to the motor (531). If, when the counter value is compared to the maximum value, the count has reached the maximum value, the return stroke is complete, so the drive begins the next power stroke.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A system comprising:

one or more pieces of surface equipment positioned at the surface of a well;

an electric submersible pump (ESP) system positioned downhole in the well; and a power cable coupled between the one or more pieces of surface equipment and the ESP system;

wherein the ESP system includes a linear motor and a reciprocating pump coupled to be driven by the motor;

wherein the motor includes a plurality of position sensors located at different positions along a stroke of a mover within the motor, wherein each position sensor is configured to sense that the mover of the motor is in a corresponding, different position within the motor;

wherein the ESP system includes circuitry that combines outputs of each of the plurality of position sensors into a single composite signal, wherein for each of the plurality of position sensors, a corresponding component of the composite signal which results from the output of the position sensor is indistinguishable from components of the composite signal which result from the output of other ones of the position sensors; and wherein the system includes a single channel coupled between the ESP system and the one or more pieces of surface equipment that carries the composite signal from the ESP system to the one or more pieces of surface equipment;

wherein the surface equipment includes a control system that receives the composite signal, wherein an absolute position of the mover within the linear motor is not communicated to the control system, and wherein the control system tracks a position of the mover by counting transitions in the composite signal and produces output power in dependence on the transitions in the composite signal, wherein the output power is carried to the ESP system via the power cable.

2. The system of claim 1, wherein the control system comprises a variable speed drive (VSD).

3. The system of claim 2, wherein the VSD comprises a speed controller, wherein the speed controller determines a current speed of the motor and controls the VSD to produce output power which drives the ESP system at a desired speed.

4. The system of claim 1, wherein the control system performs an initialization procedure at startup and thereby identifies a starting position of the mover in the linear motor and thereafter produces output power that drives the linear motor based on the identified starting position of the mover in the linear motor.

5. The system of claim 4, wherein the control system: produces an initial power stroke voltage; monitors the composite signal; determines from the composite signal whether the mover has moved in response to the initial power stroke voltage; if the mover has moved in response to the initial power stroke voltage, continues to produce the initial power stroke voltage; and if the mover has not moved in response to the initial power stroke voltage, increases the power stroke voltage and continues monitoring the composite signal and determines from the composite signal whether the mover has moved in response to the increased power stroke voltage.

6. The system of claim 1, wherein the single channel that carries the composite signal from the ESP system to the one or more pieces of surface equipment comprises a dedicated electrical line.

7. The system of claim 1, wherein the circuitry that combines outputs of the plurality of position sensors into the composite signal comprises an XOR gate that receives each of the outputs of the plurality of position sensors as inputs and produces the composite signal as an output.

8. The system of claim 1, wherein the plurality of position sensors comprise Hall effect sensors.

9. The system of claim 8, wherein the composite signal comprises a includes a signal transition corresponding to each signal output by each of the Hall effect sensors.

* * * * *